US005666821A

United States Patent [19]

Foster et al.

[11] Patent Number: 5,666,821

[45] Date of Patent: Sep. 16, 1997

[54] METHOD FOR PRODUCING PELLETS FOR USE IN A CRYOBLASTING PROCESS

[75] Inventors: Christopher A. Foster, Clinton; Paul W. Fisher, Heiskell, both of Tenn.

[73] Assignee: Lockheed Martin Energy Systems, Inc., Oak Ridge, Tenn.

[21] Appl. No.: 426,826

[22] Filed: Apr. 21, 1995

Related U.S. Application Data

[62] Division of Ser. No. 55,691, Apr. 29, 1993, Pat. No. 5,472, 369.

[51] Int. Cl.[6] ..... F25J 1/00

[52] U.S. Cl. ..... 62/605; 62/69; 62/70

[58] Field of Search ..... 62/602, 603, 605, 62/69, 70

[56] References Cited

U.S. PATENT DOCUMENTS

| | | | |
|---|---|---|---|
| 2,217,678 | 10/1940 | Goosmann | 62/602 |
| 2,570,074 | 10/1951 | Rupp | 62/603 |
| 2,608,838 | 9/1952 | Rupp | 62/603 |
| 3,124,442 | 3/1964 | Rich | 62/602 |
| 3,670,516 | 6/1972 | Duron et al. | 62/605 |
| 3,676,963 | 7/1972 | Rice et al. . | |
| 3,702,519 | 11/1972 | Rice et al. . | |
| 3,817,045 | 6/1974 | Muska | 62/605 |
| 3,901,044 | 8/1975 | Vahl | 62/605 |
| 4,617,064 | 10/1986 | Moore . | |
| 4,744,181 | 5/1988 | Moore . | |
| 4,806,171 | 2/1989 | Whitlock . | |
| 5,207,068 | 5/1993 | Bridden | 62/70 |
| 5,249,426 | 10/1993 | Spivak et al. | 62/605 |

OTHER PUBLICATIONS

Product Bulletin (undated) related to Blastrac ™ Portable Shot Blast Cleaning Systems from Wheelabrator Corporation.

Product Bulletin (undated)related to Cyroflash Model CD–1000 shot deflashing machine from Cyroquip Corporation.

"Source of Uniform–Sized Liquid Droplets" by J.M. Sneider and C.D. Hendricks, *The Review of Scientific Instruments*, vol. 35, No. 10, 10.

"Apparatus for Producing Uniform Solid Spheres of Hydrogen", C.A. Foster, et al. *Rev. Sci. Instrum.* vol. 48, No. 6, Jun. 1977.

*Primary Examiner*—Ronald C. Capossela

*Attorney, Agent, or Firm*—Michael E. McKee; James M. Spicer

[57] ABSTRACT

A cryoblasting process having a centrifugal accelerator for accelerating frozen pellets of argon or carbon dioxide toward a target area utilizes an accelerator throw wheel designed to induce, during operation, the creation of a low-friction gas bearing within internal passages of the wheel which would otherwise retard acceleration of the pellets as they move through the passages. An associated system and method for removing paint from a surface with cryoblasting techniques involves the treating, such as a preheating, of the painted surface to soften the paint prior to the impacting of frozen pellets thereagainst to increase the rate of paint removal. A system and method for producing large quantities of frozen pellets from a liquid material, such as liquid argon or carbon dioxide, for use in a cryoblasting process utilizes a chamber into which the liquid material is introduced in the form of a jet which disintegrates into droplets. A non-condensible gas, such as inert helium or air, is injected into the chamber at a controlled rate so that the droplets freeze into bodies of relatively high density.

9 Claims, 6 Drawing Sheets

METHOD FOR PRODUCING PELLETS FOR USE IN A CRYOBLASTING PROCESS

This is a divisional of application Ser. No. 08/055,691, filed Apr. 29, 1993, now U.S. Pat. No. 5,472,369.

BACKGROUND OF THE INVENTION

This invention relates generally to means and methods for removing unwanted layers from a surface and relates, more particularly, to the removal of such layers by cryoblasting processes.

Conventional cryoblasting systems utilized for removing unwanted layers, such as paint, from a surface commonly use compressed gas to accelerate solid bodies of cryogenic pellets, such as dry ice (carbon dioxide) pellets, toward a target area. Cryogenic pellets used in such applications provide an advantage in that the pellets evaporate (after use) and do not become part of the solid waste or are emitted as pollutants into the air and may, for these reasons, be preferred over conventional solvents or blasting grits used for similar purposes. Moreover, the acceleration of pellets in a venturi nozzle using compressed air in conventional techniques is highly inefficient.

Unwanted layers comprised, for example of epoxy and urethane paints of the type used on modern aircraft, are difficult to remove from a surface by conventional compressed air techniques unless air pressures used to accelerate the pellets toward the target area are elevated to very high levels. These high air pressure levels can severely degrade the pellets and produce a wide variation in the size and speed of the pellets impacting the target area which, in turn, can damage the substrate from which the unwanted layers are being removed. Moreover, the air/pellet stream may cause a rapid cooling of the target area, which cooling may adversely affect the removal of layers of material, such as paint. Still further, the compressed gas used in conventional techniques commonly must be cleaned, i.e., oil and water removed, before being used in some cleaning applications and normally requites relatively large filter systems to remove contaminants after use. It would be desirable to provide a cryoblasting system which circumvents the aforementioned problems normally associated with the use of compressed air in applications involving the removal of unwanted layers from a surface.

Furthermore, cryoblasting processes commonly require large quantities of high density cryogenic pellets. Materials such as argon and carbon dioxide which have high triple pressures, can be readily frozen by injecting the material (in a liquid state) into a chamber maintained below the triple pressure in a process commonly referred to as flashing. However, this process expands and freezes as a porous snow rather than a dense solid. To fabricate high-density pellets from the snow, extrusion machines are used to compress the snow at high pressure and force the material through orifices to produce solid sticks of ice which are chopped into pellets. If the extrusion pressure is high enough, the pellets can achieve a desired, full density.

It is an object of the present invention to provide a new and improved cryoblasting system and method for removing unwanted layers, such as paint, from a surface.

Another object of the present invention is to provide such a cryoblasting system and method which circumvents problems commonly associated with the utilization of highly compressed air for directing pellets toward a target area and which is more efficient than compressed air systems used for accelerating cryogenic pellets toward a target area.

Yet another object of the present invention is to provide new and improved means for accelerating pellets toward a target area in a cryoblasting process.

Still another object of the present invention is to provide a new and improved system and method for producing cryogenic pellets wherein the system and method are well-suited for large-quantity production of the pellets.

A further object of the present invention is to provide such a pellet-producing system and method which circumvents the need for extrusion machines and techniques used in conventional pellet production processes.

SUMMARY OF THE INVENTION

This invention resides in a cryoblasting system and method for removing paint from a surface, a centrifugal accelerator for accelerating cryogenic pellets, and a system and method for producing pellets from a liquid material having a relatively high triple point pressure.

The cryoblasting paint removal system of the invention includes means for treating the surface from which paint is desired to be removed so that the paint is softened and a centrifugal pellet accelerator for receiving cryogenic pellets from a source and for directing the pellets toward the treated surface to remove the softened paint from the surface. By softening the paint prior to the directing of cryogenic pellets thereagainst, the rate of paint removal is increased.

The centrifugal accelerator of the invention includes a throw wheel assembly mounted for rotation about an axis and including a disc-like body defining an internal passage having an entrance situated at a location offset from the rotation axis and an exit located adjacent the periphery of the body. Means are associated with the throw wheel assembly for rotating the wheel assembly about its axis of rotation, and the internal passage of the wheel assembly body is configured so that upon rotation of the wheel assembly about its axis, pellets introduced into the passage at the entrance thereof are carried into the passage and accelerated through the entrance therefor. A housing is positioned about the wheel assembly and includes an exhaust duct disposed adjacent the periphery of the wheel assembly body for directing accelerated pellets discharged from the exit of the wheel assembly passage toward a target area.

The pellet-producing system of the invention includes means defining a chamber having an entrance end portion and an exit end portion and means for introducing the liquid material into the entrance end of the chamber as a jet (or jets) which disintegrates into droplets. Means are provided for injecting a non-condensible gas into the chamber, and control means are connected between the chamber and the injecting means for maintaining the total pressure of the chamber at a pressure which is at or slightly below the triple pressure of the droplet-forming liquid and while maintaining a low partial pressure of the droplet-forming liquid so that the droplets freeze into solid bodies of relatively high density.

The pellet-producing method of the invention includes the steps performed by the pellet-producing system. More specifically, a chamber is provided, and the liquid material is introduced into the chamber as a jet (or jets) which disintegrates into droplets. A non-condensible gas is injected into the chamber, and the chamber conditions are maintained so that the total pressure of the chamber is maintained at or slightly below the triple pressure of the droplet-forming liquid while maintaining a low partial pressure of the droplet-forming liquid so as to freeze the droplets into solid bodies of relatively high density.

DETAILED DESCRIPTION OF THE ILLUSTRATED EMBODIMENTS

Figure 1:
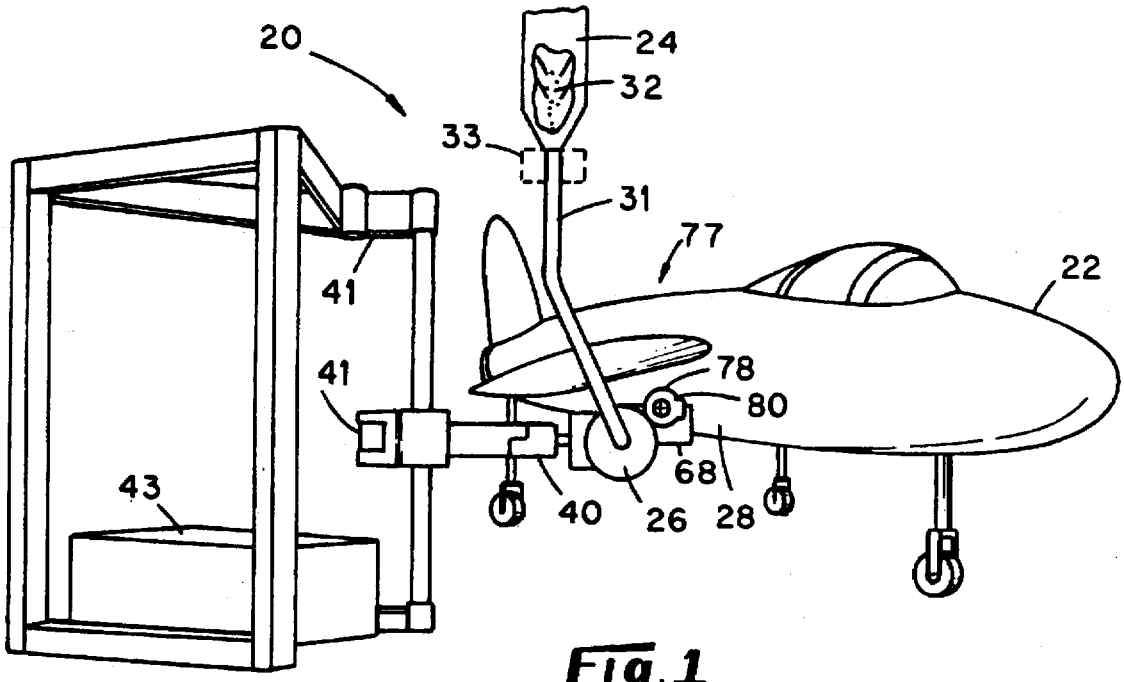
FIG. 1 is an elevational view illustrating a paint removal system embodying features of the present invention shown partially cut-away and in position for removing paint from the body of an aircraft.

Turning now to the drawings in greater detail, there is shown in FIG. 1 a cryoblasting paint removal system, generally indicated 20, shown positioned alongside the fuselage of an aircraft 22 for removing paint from the aircraft surface. The system 20 includes a source 24 of frozen pellets 32 and a centrifugal accelerator 26 for directing the pellets 32 in a stream toward a target area 28 of the aircraft surface desired to be stripped of paint. In the depicted example, the aircraft surface has been coated with an epoxy primer, and the epoxy primer has been overlain with at least one coat of paint. During operation, the system 20 removes the primer layer, as well as the outer coating of paint, from the target area 28.

The pellets 32 utilized in the system 20 are cryogenic bodies of material, such as argon or carbon dioxide (i.e., dry ice), which have a relatively high triple point temperature. As will be apparent herein, the pellets 32 are produced in accordance with an embodiment of a process of the present invention to provide the pellet bodies with a relatively high density. In the system 20, the pellets 32 are produced at the source 24 and fed to the accelerator 26 soon after production. In the alternative, the pellets 32 may be stored in a relatively large quantity at a source and fed to the accelerator 26 from this stored quantity.

Figure 2:
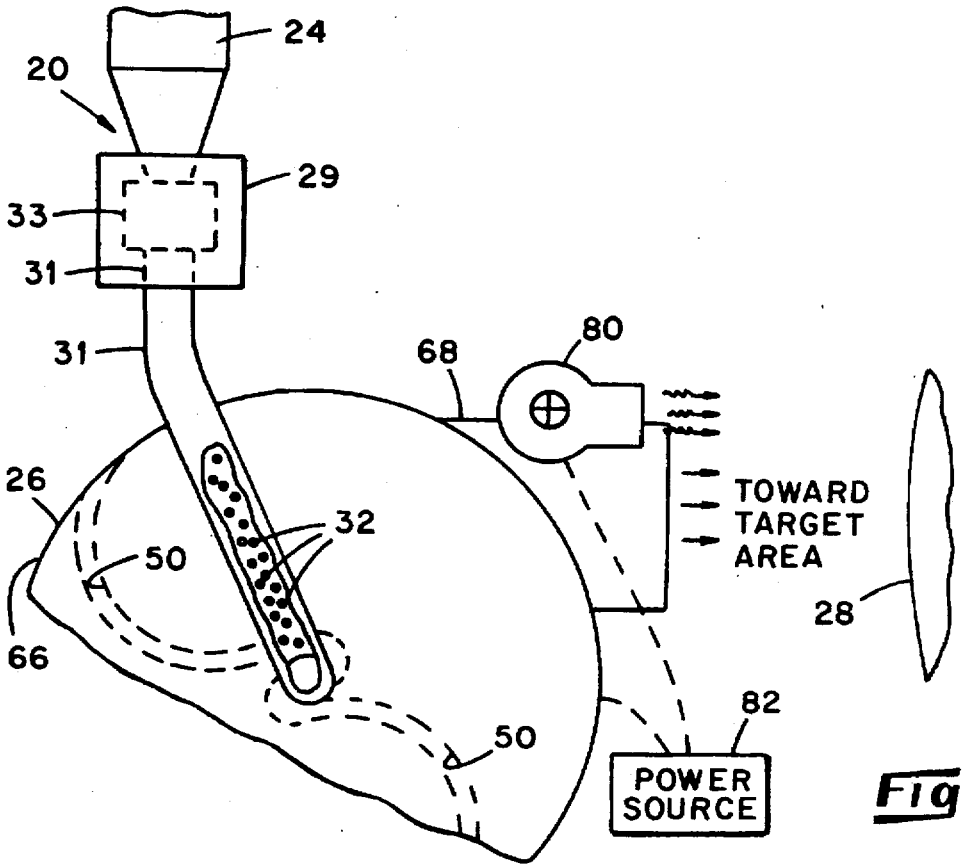
FIG. 2 is a view similar to that of FIG.1 illustrating in block diagram form the operation of the FIG. 1 system.

With reference to FIGS. 1 and 2, the system 20 includes a feed tube 31 which extends between the source 24 and the accelerator 26 for conducting pellets 32 from the lower, i.e. discharge, end of the source 24 to the entrance of the accelerator 26. As will be apparent herein, the pellets 32 are delivered to the accelerator 26 in a continuous stream. To this end, the pellets 32 are produced at the source 24 at a controlled rate so that following production, the pellets 32 are routed through the tube 31 and delivered directly into the accelerator 26. As mentioned above, pellets could be delivered to the accelerator 26 from a stored source. To this end, the system can include a metering system 33 (FIG. 1) including, for example, a rotating screw auger disposed at the stored source for introducing pellets into the delivery tube 31 at a controlled rate.

Although an accelerator which is suited for use within the depicted system 20 may take any of a number of forms, the accelerator 26 is designed to accelerate pellets 32 toward the target area 28 in a manner which reduces the frictional forces generated between the surfaces of the pellets 32 and the internal passages of the accelerator 26. In this connection and with reference to FIGS. 3 and 4, the accelerator 26 is in the form of a relatively compact apparatus including a motor housing 34 and a wheel housing 36 which are joined together as a single unit 38. The unit 38 can be, in turn, supported upon the end of a robot arm 40 (FIG. 1) having linkages 41 which enable the accelerator 26 to be moved in a direction along any of three coordinate axes or to be pivoted about an axis of rotation. A computer-operated controller 43 is joined to the linkages 41 for controlling the movement of the accelerator 26 during operation of the system 20. The controller 43 is preprogrammed with input relating to the size and shape of the aircraft 22 so that the robot arm 40 directs the accelerator 26 over substantially the entire painted surface area of the aircraft 22.

Figure 3:
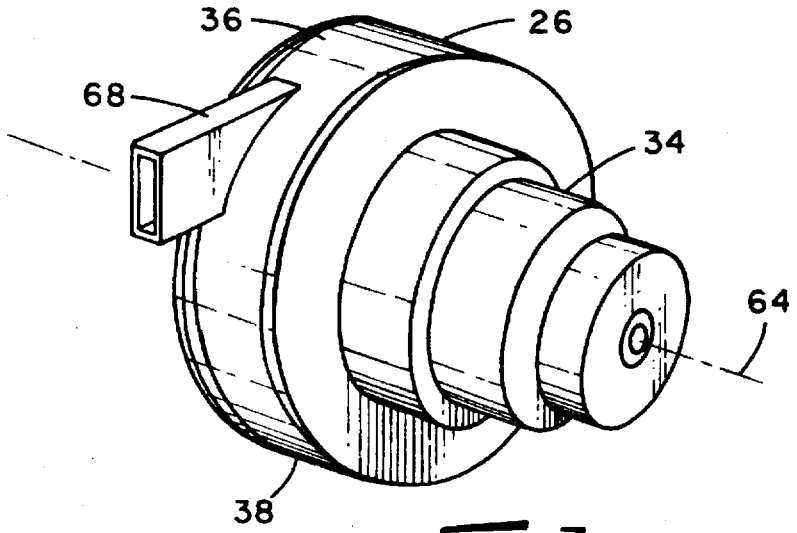
FIG. 3 is a perspective view of the centrifugal accelerator utilized in the FIG. 1 system.
Figure 5:
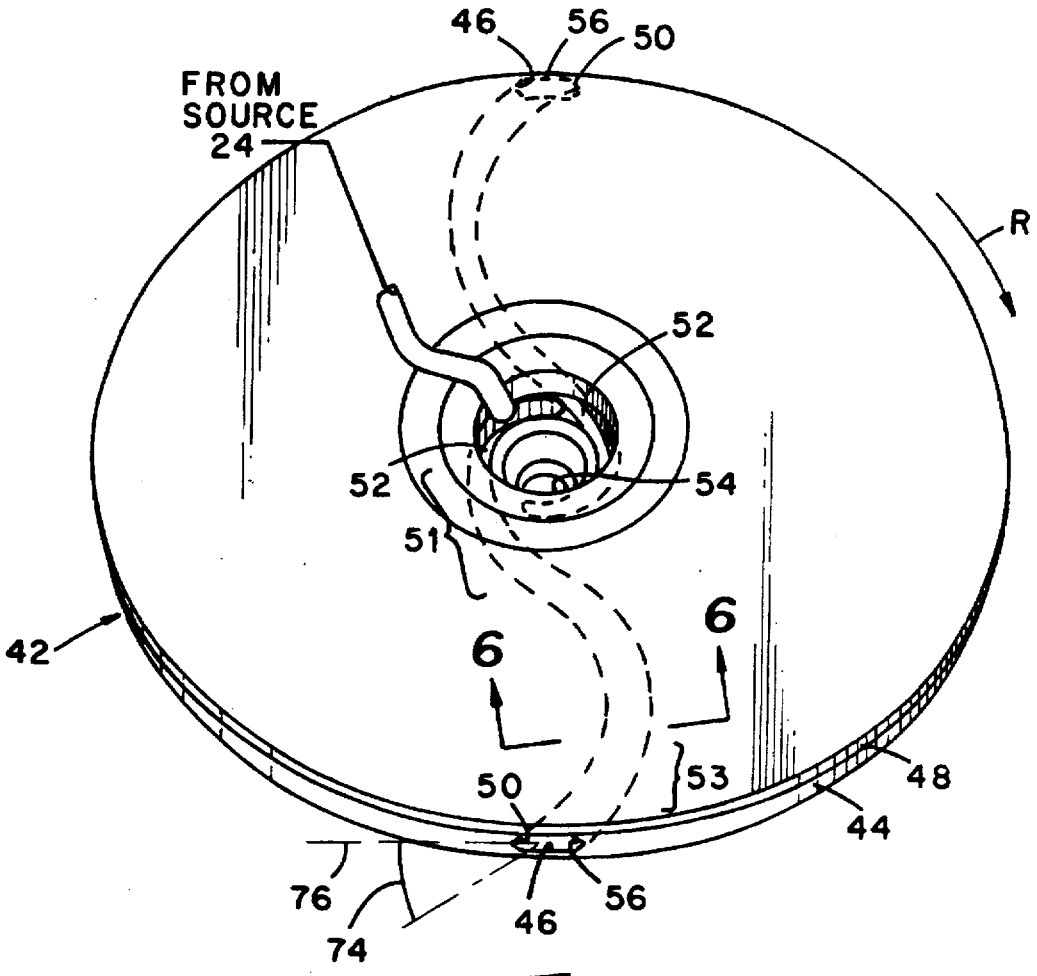
FIG. 5 is a perspective view of the throw wheel assembly of the FIG. 3 accelerator.
Figure 5A:
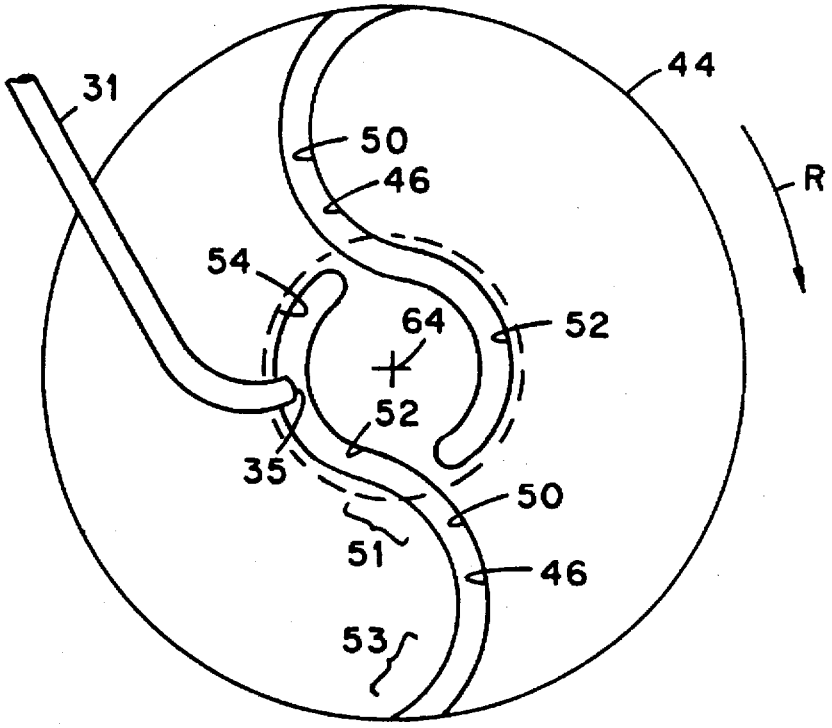
FIG. 5*a* is a plan view of the grooved plate of the FIG. 5 wheel assembly illustrating schematically the paths of the pellet flow passages through the assembly.

With reference to FIGS. 3, 5 and 5*a*, the accelerator 26 includes a throw wheel assembly 42 rotatably mounted within the wheel housing 36. The wheel assembly 42 includes a disc-like plate 44 having a side face within which an array of grooves 46 are machined. A disc-like cover 48 having a center opening 54 is fixedly secured across the grooved face of the plate 44 so that the cover 48 and the walls of the grooves 46 collectively define an array of elongated passages 50 which extend generally radially through the assembly 42 from an elongated entrance 52 adjacent the plate center opening 54 to an exit 56 which opens out of the periphery of the assembly 42. Access to the entrances 52 is provided by the center opening 54. In the depicted assembly 42, the cross section of each passage 50 taken at any point between its entrance 52 and exit 56 is relatively small. Although the wheel assembly 42 may be any of a number of sizes, the diameter of the depicted wheel assembly 42 is about 14.0 inches. Each of the plate 44 or the cover 48 can be constructed, for example, of metal, such as aluminum.

Figure 4:
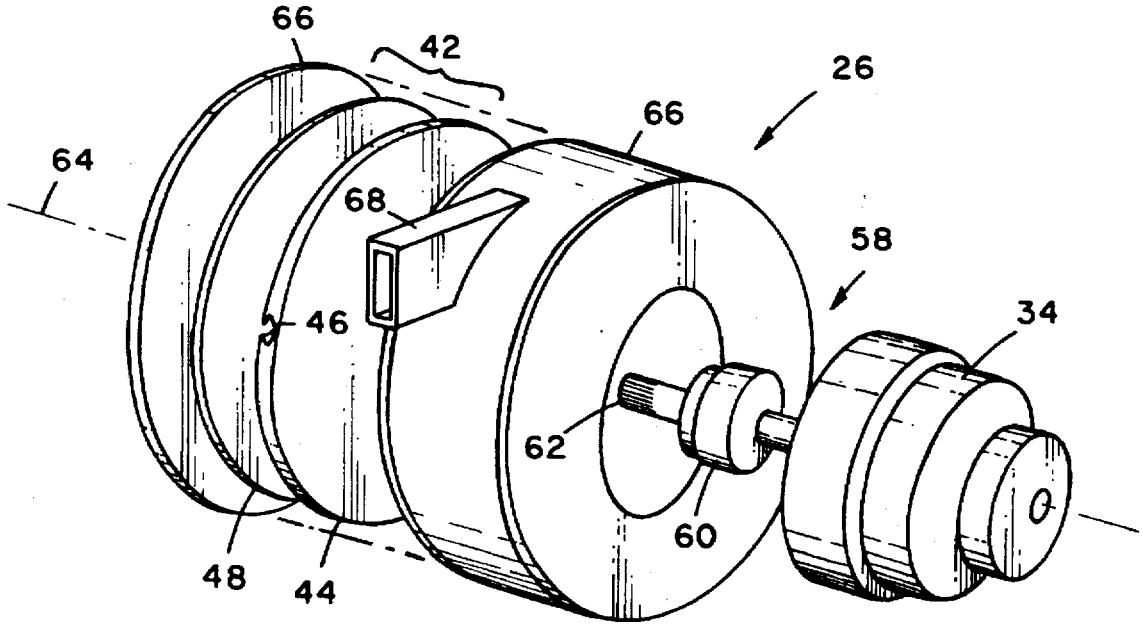
FIG. 4 is a perspective view of the accelerator of FIG. 3, shown exploded.

As best viewed in FIG. 4, the throw wheel assembly 42 is mounted upon a ball bearing spindle, and an electric motor 58 having a water-cooled stator and a rotor 60 is mounted within the motor housing 34. Joined to the rotor 60 is a rotatable shaft 62 which is suitably coupled in driving relationship with the throw wheel assembly 42 through the spindle for rotating the wheel assembly 42 about an axis 64 of rotation. Preferably, the motor 58 is a variable speed motor enabling the rotational speed of the wheel assembly 42 to be controlled.

The wheel housing 36 includes a two-piece (as viewed in FIG. 4) cover portion 66 positioned about so as to substantially enclose the wheel assembly 42. For safety purposes, belts of material commercially available under the trade designation Kevlar or some other blast shield material, such as sheet steel, may be incorporated within the peripheral walls of the cover portion 66 to contain the wheel assembly 42 in case of failure. The housing 36 also includes an exhaust duct 68 attached about an opening provided in a peripheral wall of the cover portion 66. The duct 68 is substantially rectangular in cross section providing a rectangular or slit-like opening of, for example, about 3.0 inches in length. As shown in FIG. 2, the duct 68 is attached to the cover portion 66 so as to extend angularly, rather than radially, therefrom. During operation of the accelerator 26, the pellets 32 are thrown through the exit 56 (FIG. 5) of the wheel assembly 42 and are directed in a stream through the exhaust duct 68 toward the target area 28 (FIG. 2).

Figure 6:
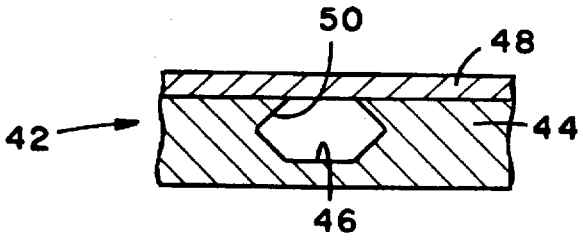
FIG. 6 is a cross-sectional view taken along line 6—6 of FIG. 5.

As mentioned earlier, the pellets 32 are moved through the accelerator 26 in a manner which reduces the frictional forces which would otherwise tend to retard pellet movement. To this end, the passage 50, and in particular the grooves 46, are machined to a smooth, polished finish and shaped so as to provide each passage 50 with a somewhat diamond-shaped cross section, as shown in FIG. 6. Moreover and as shown in FIGS. 5 and 5*a*, each passage 50 follows an arcuate, generally C-shaped path as the passage 50 is traced from the entrance 52 to the exit 56. More specifically, each passage 50 includes an inwardmost section 51 which is canted rearwardly with respect to the direction of rotation of the wheel assembly 42 (as a path is traced generally radially across the assembly 42 from the center opening 54), and each passage 50 also includes an outwardmost section 53 which is canted forwardly with respect to the direction of rotation of the wheel assembly 42. As the wheel assembly 42 is rotated and pellets 32 are fed into each passage 50, the rearwardly-canted section 51 provides a soft pick-up, or acceptance, of the pellets 32 to reduce the likelihood of damage to the pellets upon impact with the passage walls. The forwardly-canted section 53 effects a throwing of the pellets 32 from the wheel assembly 42 in a direction which corresponds with the direction of wheel rotation.

The speed of the pellets thrown from the passage exits 56 can be varied by changing the rotational speed of the wheel assembly 42. In accordance with Newtonian principles and for a given wheel assembly speed, the speed of each pellet 32 exiting a passage 50 is the same. Thus, there is little or no spread between the velocities of the individual pellets 32 which exit the passages 50, and the accelerator 26 is further advantageous in this respect.

Figure 6A:
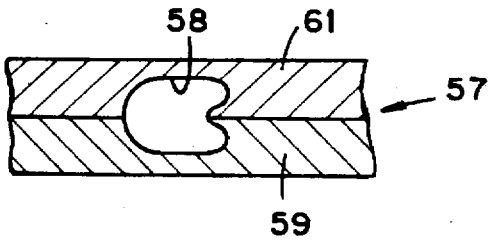
FIG. 6*a* is a cross-sectional view similar to that of FIG. 6 of a throw wheel assembly of another embodiment of the centrifugal accelerator.

Although the passages 50 of the depicted wheel assembly 42 have been shown and described above as having somewhat diamond-shaped cross section and which shape is defined primarily by the shape of the grooves, the passages may possess any of a number of cross-sectional shapes and may be collectively defined by cooperating grooves in the wheel assembly. For example, there is shown in FIG. 6*a* an alternative wheel assembly 57 having a passage 58 which is somewhat kidney-shaped in cross section and which collectively provided by opposing (double) grooves provided in the wheel assembly plate 59 and cover 61. These double grooves can increase e.g. double, the carrying capacity of pellets for each groove and provide two adjacent cleaning streams (each of which emit from a corresponding lobe provided in the passage cross section) which passes over the surface with a single pass of the accelerator 26.

During operation of the accelerator 26 and as mentioned earlier, pellets are conducted to the accelerator 26 from the source 24 by the feed assembly 26 in a continuous stream. In this connection, the feed of the pellets through the tube 31 is coordinated with the accelerator 26 so that upon entering the central opening 54 of the assembly 42, the proper flow rate of pellets enter the entrance 52 of a corresponding passage 50 to obtain the desired cleaning rate over the target area 28. As best shown in FIG. 5*a*, the entrance 52 of each passage 50 is elongated in shape and extends for a substantial distance around the inner collection perimeter (accessible through the center opening 54) of the assembly 42.

From the location (along the length of the passage entrance 52) that the pellets 32 enter a passage entrance 52, the wheel assembly 42 rotates about its axis through a predetermined (mathematically calculable) number of angular degrees before the pellets are thrown through the passage exit 56. In the system 20, the wheel assembly 42 rotates about its axis through about 110° between the location of acceptance (along the entrance 52) of the pellets and the angular location about the rotation axis 64 at which the pellets are discharged from the wheel assembly 42. Accordingly, the location within the assembly center opening 54 at which the tube 31 directs the pellets into a passage entrance 52 is about 110° rearwardly (with respect to the direction of rotation, indicated R in FIGS. 5 and 5*a*, of the wheel assembly 42) of the location of the exhaust duct 68. Therefore, upon rotation of the wheel assembly 42 through about 110° of rotation from the location along which pellets enter a passage entrance 52, the passage exit 56 is aligned with the exhaust duct 68 so that pellets which move through the passage exit 56 immediately enter the duct 68. The discharge of pellets 32 through the passage exit 32 can be tuned to properly align with the duct 68 by adjusting, by repositioning the tube end 35, the location along the entrance 52 into which the pellets are introduced.

It has been found that by controlling the length of the period of arc over which pellets are introduced to a passage entrance 52, the spread, or splay, of the stream of pellets 32 through the duct 68 can be controlled. For example, by introducing a stream of pellets to a passage entrance 52 over a very short period of arc (such as through a tube end 35 of relatively small circular cross section), the width of the resultant pellet stream discharged from the duct 68 will be relatively small. Conversely, by introducing a pellet quantity to a passage entrance 52 over a longer period of arc (such as through a tube end 35 of elongate, or lengthy, cross section), the width of the resultant pellet stream discharged from the duct 68 will be more elongated in shape, which shape corresponds to a more fan-like appearance of the pellet stream. The shape of the pellet stream may be desired to be accurately controlled if, for example, it is necessary in an application to concentrate the pellet stream upon a small area, as opposed to disperse the pellet stream over a wide area, of the target.

Upon entering the passage entrances 52, the pellets 32 are accelerated by the contact forces between the passage surfaces and the pellet surfaces so that the pellets 32 exit the wheel assembly 42 through the exits 56 at a relatively high rate of speed. As long as the wheel assembly 42 and, more particularly, the surfaces of the passages 50, are at a temperature which is well above the triple point temperature of the pellets 32 routed therethrough, the pellets 32 ablate, to a degree, so that as they move through the passages 50, the pellet ablation produces a low-friction gas. This produced gas provides a low-friction bearing which moves with the pellets 32 through the passages 50 and reduces frictional forces that would otherwise retard pellet acceleration. Since the accelerator 26 is expected to be utilized under ambient conditions which are well above the triple point temperatures of the pellets 32, the low-friction gas bearing is expected to be produced during normal operating conditions of the accelerator 26. This gas bearing reduces drag forces on the pellets 32 as the pellets move through the passages 50 to provide efficient acceleration of the pellet stream.

The speed of the pellets 32 exiting a passage exit 56 is affected by the angle at which the passage exit or, more specifically, the outermost section 53 of the passage 50 is sloped with respect to the tangent of the assembly 42. In the depicted wheel assembly, the outermost section 53 is sloped so that the velocity of the pellets 32 exiting the assembly 42 is about twice the tip speed of the assembly 42 times the cosine of one-half the angle 74 (FIG. 5) of the passage 50 at the exit 56 with respect to a tangential line 76 drawn adjacent the assembly 42 at the exit 56. In practice and at atmospheric pressure, the drag forces generated from the air moving through the passages 50 tend to reduce pellet speed. However, the closed acceleration passages 50 operate as centrifugal air accelerators so that air is accelerated along with the pellets thereby enhancing pellet speed with the favorable drag effect of the air. Moreover, this centrifugal acceleration of the air within the passages induces a suction at the passage entrances 52 which is believed to aid in the acceptance of the pellets 32 by the passages 50. Thus, in addition to improving the pellet delivery and providing effective pellet delivery at all pellet speeds, the aforedescribed passage design also improves the pellet throughput.

As mentioned earlier, pellets 32 conducted from the passage exits 56 are discharged from the accelerator 26 through the exhaust duct 68 of the housing 36 along with a column of accelerated air, toward the target area 28. The geometry of the housing 36 and duct 68 are selected so as to minimize loss of speed of the air moving through the duct 68. To this end, the duct 68 is attached to the cover portion 66 of the housing 36 at an angle, as shown in FIG. 3, so that the pellets 32 are discharged from the accelerator 26 in a (forward) direction having a directional component which corresponds with the direction of rotation of the wheel assembly 42.

The aforedescribed smooth-surfaced, covered, wheel-shaped accelerator 26 is preferred over a rotating arm or a hoop design used as a pellet accelerator since the accelerator 26 reduces the drag forces on the wheel assembly 42 and reduces turbulence at the edge of the assembly 42, which normally affects the trajectory of the pellets 32 exiting the device.

Test results performed on an accelerator comparable in structure to that of the accelerator revealed that a drive motor of 15 horse power is capable of rotating the wheel assembly 42 at 10,000 revolutions per minute at atmospheric pressure and is capable of delivering pellets through its exhaust duct at about 1,050 feet per second. During operation of such an accelerator, its exhaust duct is expected to scan a target area with a clearance of about 1.0 inch.

With reference again to FIGS. 1 and 2, the system 20 also includes means, generally indicated 77, for treating the target area 28 to soften the paint covering the area 28. In the depicted system 20, the treating means 77 included means, generally indicated 78, for preheating the target area 28 prior to the directing of pellets 32 from the accelerator 26 against the target area 28. The preheating means 78 of the depicted system 20 is provided, for example, by an electrically-powered heating gun 80 mounted adjacent the exhaust duct 68 of the accelerator 26, but the preheating means 78 may take an alternative form, such as a high-intensity (i.e., radiant) lamp, laser, or microwave heating device. As does the motor 58 of the accelerator 26, the heating gun 80 receives operating power from an electric power source 82.

The heating gun 80 of the depicted system 20 is mounted alongside the exhaust duct 68 so that heated air generated by the gun 80 is directed toward so as to substantially cover the target area 28 and areas adjacent the target area 28. By heating areas adjacent the target area 28, these adjacent areas are preheated before the accelerator exhaust duct 68 is advanced across the surface being stripped of paint from the target area 28. Therefore, as the duct 26 is moved across the surface of the aircraft 22 (FIG. 1) in a paint-stripping operation, the aircraft surface is heated by the gun 80 in advance of duct movement.

The heat directed by the heating gun 80 toward the surface to be stripped of paint softens, and thereby weakens, the paint and thus facilitates paint removal by the pellets 32. In contrast to conventional compressed air cryoblasting processes wherein the air blast tends to cool the target surface and would thus negate the effect of preheating the surface, the stream of pellets directed from the accelerator 26 do not produce rapid cooling of the target area so that the paint remains in a softened condition until its removal from the underlying surface by the pellet stream.

Preferably, the heating gun 80 does not heat the target surface to such a degree that the underlying substrate of the surface experiences heat damage. Tests conducted on painted aluminum panels at sample temperatures of 55° C. and 90° C. showed an increase in the removal rate of the paint (when compared to panels tested at ambient temperature) and showed no damage in hardness and strength of the underlying aluminum.

It follows that since preheating a painted surface to soften the paint increases the rate of paint removal for a given pellet speed, the pellet speed can be decreased for paint removal applications with no appreciable sacrifice in paint-removal capabilities. The advantage provided by this feature can be readily appreciated when considering the fact that some substrate surfaces can be damaged by the impact of pellets thereagainst at very high speeds. It has been found that when directing argon pellets against an aluminum panel, the threshold pellet speed at which damage to the aluminum can occur is between about 600 feet per second and about 800 feet per second. Thus, the preheating feature of the system 20 permits the accelerator 26 to be operated at lower speeds and is advantageous in this respect.

Figure 7:
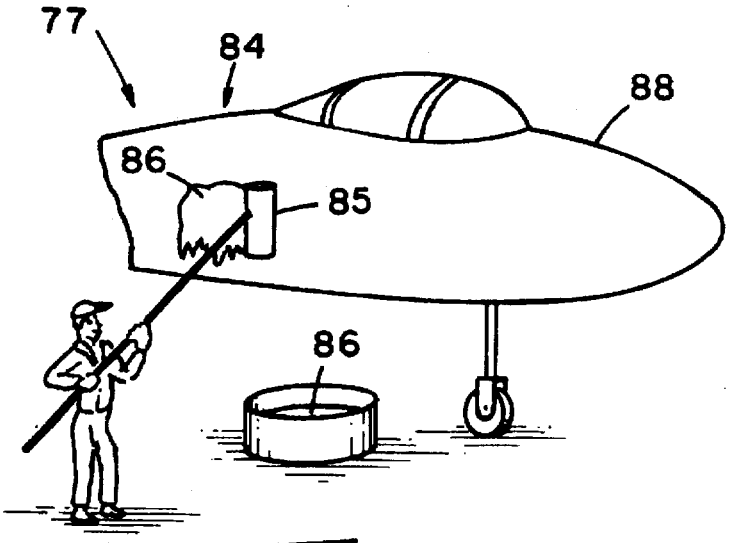
FIG. 7 is a perspective view of an alternative means for softening paint covering the surface of an aircraft.

Although the treating means 77 of the system 20 has been shown and described as including preheating means for softening the paint overlying the target area 28, the treating means 77 may take an alternative form. For example, there is illustrated in FIG. 7 treating means 77 including means, indicated 84, for coating the painted surface of an aircraft 88 with a chemical solvent adapted to soften the paint when left thereover for a prescribed period of time. In the depicted treating means 77, the coating means 84 includes application means in, for example, the form of a roller tool 86 which is dipped in a container of chemical solvent 85 and then wiped across the surface of an aircraft 88. The steps of dipping and wiping are repeated as necessary until substantially the entire surface of the aircraft 88 is covered with the solvent 86. The movement of the tool 85 during the aforedescribed dipping and wiping steps can be controlled manually or automatically with, for example, a computer-controlled robot arm assembly similar in construction and operation to the computer-controlled robot arm 40 of the system 20 of FIG. 1.

A solvent known to be an environmentally-acceptable paint softener is a ethanolamine/amine solvent. An example of an ethanolamine/amine solvent is available from McGean-Rohco under the designation CEE BEE A-477. As an alternative solvent to an ethanolamine/amine solvent, benzyl alcohol can be used. Normally, these solvents must be left coated over a painted surface for a prescribed period of time, e.g., about two hours, in order to effect the desired softening of the paint. If left coated over the surface for much longer periods, the paint softening capacity of the solvent is likely to degrade due to solvent evaporation. To achieve the most effective paint removal with a solvent and a centrifugal pellet accelerator, the accelerator is directed over the body of the aircraft (so as to impact the aircraft surface with frozen pellets) during the time period following solvent application that the paint is in its softest condition.

As mentioned earlier, the pellets 32 utilized in the depicted system 20 are in the form of frozen bodies having a relatively high density. The pellets 32 are produced from a bath material, such as liquid argon or carbon dioxide, in a process involving a source of non-condensible gas, examples of which are provided herein.

Figure 8:
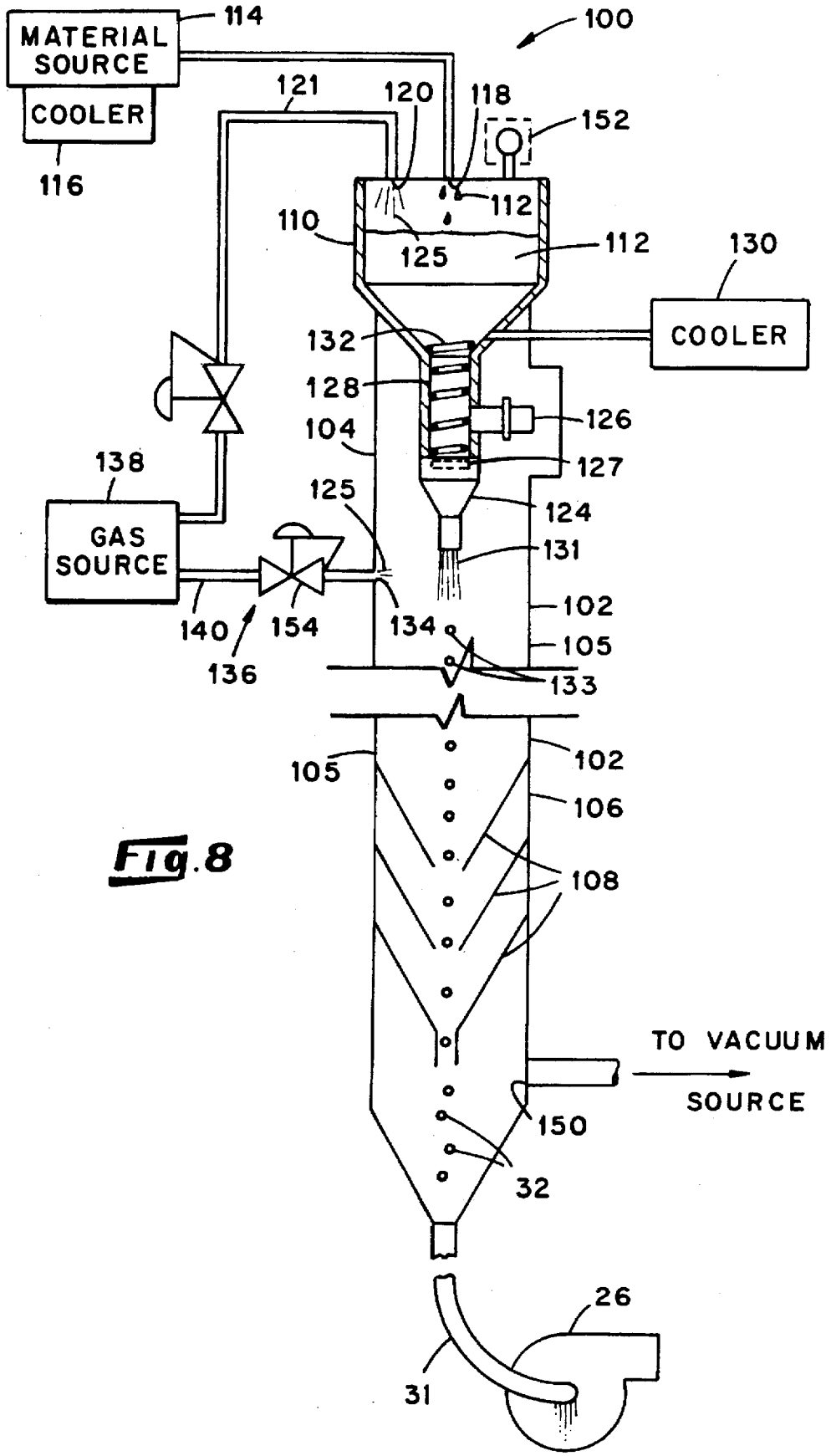
FIG. 8 is a schematic view of an embodiment of a system used for producing cryogenic pellets for cryoblasting purposes.

For the purpose of producing the pellets 32, there is illustrated in FIG. 8 a system, generally indicated 100, capable of producing the pellets 32 in large quantities. The system 100 includes an elongate chamber 102 having an entrance end portion 104, an exit end portion 106, and a lengthy drift tube portion 105 extending between the entrance and exit end portions 104, 106. Associated with the exit end portion 104 is a series of depressurization nozzles 108, three of which are shown in FIG. 8. During the formation of pellets 32 with the system 100, the internal pressure of the chamber 102 is controlled so that droplets of the liquid bath material are permitted to freeze within the drift tube portion 105 and subsequently exit the chamber 102 as high density pellets 32.

Connected to the chamber 102 at its entrance end 104 is a vacuum-insulated reservoir 110 for receiving liquid working fluid 112 from a source 114 and from which the fluid 112 is introduced into the entrance end portion 104 of the chamber 102. The working fluid 112 is a liquid bath material, such as argon or carbon dioxide, having a relatively high triple pressure and which is maintained in its liquid state (i.e., at the triple point temperature) at the source 114 by a cooler 116.

The reservoir 110 is provided with one opening 118 through which the liquid working fluid 112 is delivered thereto and another opening 120 and feed line 121 through which a pressurized, non-condensible gas 125 is introduced to the reservoir 110 from a source 138. For maintaining the reservoir 110 at a desired (triple point) temperature, there is provided cooling means 130 including a cooling coil 132 disposed adjacent the bottom of the reservoir 110. A nozzle assembly 124 having a nozzle orifice diameter of, for example, about 0.4 mm, is joined to the lower end, as viewed in FIG. 8, of the reservoir 110 so as to separate the reservoir 110 from the chamber entrance end portion 104. The lower end, indicated 128, of the reservoir 110 positioned adjacent the nozzle assembly 124 is elongated in shape, and a vibration transducer 126 is suitably attached to one side of the reservoir end 128 for inducing, during the system operation, vibrations in the reservoir end 128.

During operation of the system 100, liquid bath material 112 is delivered to the reservoir 110 and the non-condensible gas 125 is introduced, under moderate pressure (e.g., between 2 and 5 psi) to the reservoir 110 so that the liquid bath material 112 is forced to exit the nozzle 124 in a liquid jet 131. If desired, a control pressure regulator 152 can be associated with the reservoir 110 in parallel with the feed line 121 to maintain the reservoir interior at a desired pressure. Moreover, the nozzle assembly 124 may be provided with a filter 127 to reduce the likelihood that the nozzle assembly 124 will become clogged. The liquid jet 131 exits the nozzle assembly 124 and quickly disintegrates into droplets 133. This disintegration of the liquid jet 131 into droplets 133 is enhanced by the vibrations induced in the nozzle assembly 124 by the vibration transducer 126.

The chamber 102 receives the jet 133 discharged from the nozzle assembly 124 and includes an inlet port 134 adjacent its entrance end portion 104 through which the pressurized non-condensible gas 125 from a source 138 is injected into the chamber 102. The non-condensible gas from the source 138 is delivered to the chamber 102, and control means 136 are connected between the chamber 102 and the source 138 for controlling the internal pressure of the chamber 102 by controlling the introduction of the non-condensible gas 125 through the conduit 140. In the depicted system 100, the control means 136 includes a pressure regulator 154 associated with the conduit 140 which acts as a pneumatic feedback unit between the chamber 102 and the source 138. To this end, the regulator 154 includes an internal diaphragm which is exposed to the pressure of the chamber 102 and which opens and closes an internal valve in response to movement of the diaphragm to thereby control the introduction of gas 125 from the source 138.

Figure 9:
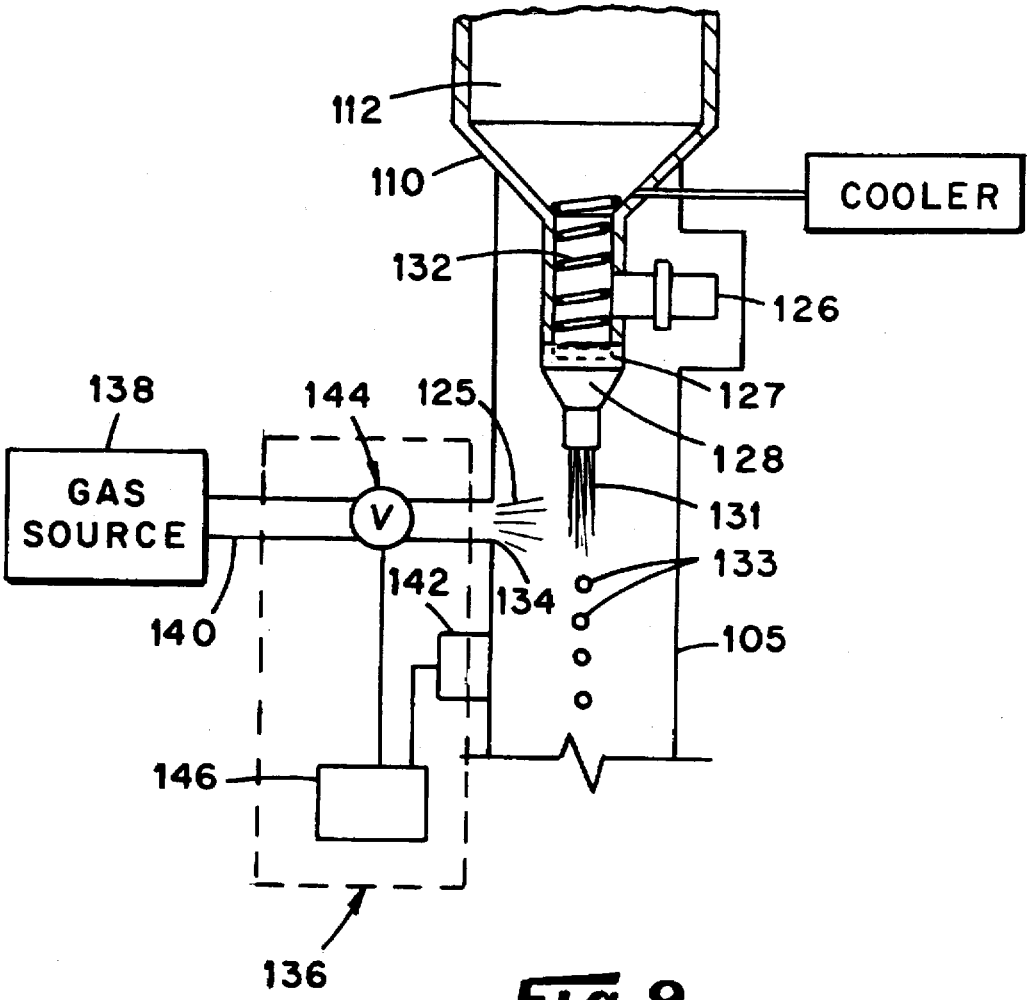
FIG. 9 is a fragmentary view similar to that of FIG. 8 within which an alternative pressure control means is utilized.

As an alternative to the pressure regulator 154, there is illustrated in FIG. 9 control means 136 including pressure monitoring means 142 attached to the chamber 102 for monitoring the internal pressure thereof, a valve 144 mounted in the conduit 140 and means 146 for controllably opening and closing the valve 144 in response to command signals received from the monitoring means 142.

During operation of the system 100, the control means 136 controls the flow of non-condensible gas from the source 138 into the chamber 102 so that the total pressure of the chamber 102 is at or slightly below the triple pressure of the liquid of the jet 133 while maintaining a low partial pressure of the droplet-forming liquid 112 within the chamber 102. The consequence of such control effects an evaporation of some of the droplet-forming liquid 112 which, in turn provides the mechanism by which the liquid droplets 133 freeze into high density solid bodies without boiling or the expansion of the liquid into snow. The length, e.g. 6.0 feet, of the drift tube section 105 accommodates at least a partial freezing of the droplets in free flight, i.e., before the droplets impact a wall of the chamber 102. The formed droplets of relatively high density are subsequently passed, under the influence of gravity and differential pressure, out of the chamber 102 through the depressurization nozzles 108 and into the feed conduit 31 (FIG. 1) for direct use by the accelerator 26. Preferably, the conduit 31 through which the pellets 32 are routed is maintained at a pressure well below the triple pressure of the material 112. Alternatively, the pellets 32 may be stored within a storage chamber until ready for use. The non-condensible gas 125 is withdrawn from the chamber 102 by means of a vacuum source connected to the chamber 102 through a discharge port 150 disposed downstream of the depressurization nozzles 108. If the working fluid 112 is argon, this vacuum-withdrawal through the port 150 is necessary (because of the low working pressures within the chamber 102), but if the working fluid 112 is carbon dioxide, this vacuum-withdrawal is not necessary and the carbon dioxide pellets can, instead, be discharged from the system 100 to atmospheric pressure.

The aforedescribed system 100 is well-suited for the production of large quantities of high density pellets. To increase the pellet-production capacity of the aforedescribed system 100, additional nozzle assemblies (comparable to the nozzle assembly 124) may be incorporated within the reservoir 110 for introducing additional jets of the working fluid 112 into the chamber 102. Moreover, the size of the resulting pellets 32 can be altered by changing the orifice size of the nozzle assembly 124. Still further, the production rate of pellets can be controlled by controlling the pressure of the feed reservoir by means of the gas 125. It has been found that the diameter of the droplets produced from the jet 131 are approximately twice the diameter of the orifice, or jet diameter.

If the liquid working fluid 112 delivered to the reservoir 110 is argon (or another inert gas), the non-condensible gas delivered from the sources 114 and 138 to the reservoir 110 and chamber 102, respectively, is helium gas. Exemplary operating conditions of the system 100 when the working fluid 112 is argon are provided here as follows. The internal pressure of the reservoir 110 is about 1,000 Torr and the temperature of the reservoir 110 is about 83K, the internal pressure (total) of the chamber 102 is maintained at about 620 torr, and the pressure on the downstream side of the last depressurizing nozzle 108, i.e., the nozzle 108 adjacent the discharge port 150, is maintained at about 60 Torr. Moreover, helium gas is capable of being injected into the chamber 102 from the source 138 at up to about 65 cubic feet per minute.

In the alternative, if the liquid working fluid 112 delivered to the reservoir 110 is carbon dioxide, the non-condensible gas delivered from the sources 114 and 138 to the reservoir 110 and chamber 102, respectively, can be dry air or nitrogen. Exemplary operating conditions of the system 100 when the working fluid 112 is carbon dioxide are provided here as follows. The internal pressure of the reservoir 110 is about 4,640 Torr and the temperature of the reservoir 110 is about 217K, the internal pressure (total) of the chamber 102 is maintained at about 4340 torr, and the pressure on the downstream side of the last depressurizing nozzle 108 is maintained at about 740 torr (which is atmospheric). Moreover, air is capable of being injected into the chamber 102 from the source 138 at up to about 65 cubic feet per minute.

It will be understood that numerous modifications and substitutions can be had to the aforedescribed embodiments without departing from the spirit of the invention. For example, although the centrifugal accelerator 26 has been shown and described for use in conjunction with cryoblasting paint removal applications, these embodiments may be used in other applications, such as etching or cleaning applications such as, for example, the removal of heavy oxides from steel, radioactive decontamination, rust removal, and the removal of oily films from surfaces and with other types of pellets, such as extruded-type pellets or dry ice granules. Similarly, the aforementioned pellet producing means and methods may also be used to produce solid dense pellets of any cryogenic fluids for other processes not related to paint removal or cleaning applications.

Figure 10:
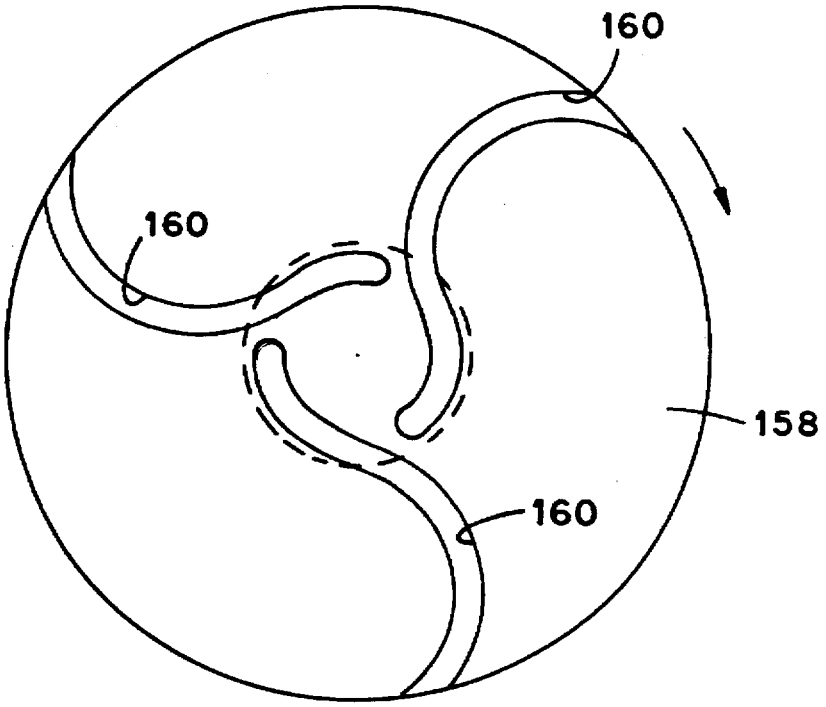
FIG. 10 is a view similar to that of FIG. 5*a* illustrating schematically the paths of flow passages of a throw wheel assembly for an alternative accelerator.

Still further, although the accelerator 26 of the aforedescribed system 20 has been shown and described as including a throw wheel assembly 42 having two passages 50, a throw wheel assembly in accordance with the broader aspects of the invention may possess an alternative number of passages. For example, there is shown in FIG. 10 a grooved plate 158 of a throw wheel assembly provided with three passages 160. Accordingly, the aforedescribed embodiments are intended for the purpose of illustration and not as limitation.

What is claimed is:

1. A system for producing cryogenic pellets from a liquid material having a relatively high triple point pressure, the system comprising:

means defining a chamber having an entrance end portion and an exit end portion;

means for introducing the liquid material, under moderate pressure, into the entrance end portion of the chamber as a liquid jet so that the jet disintegrates into droplets;

means for injecting a non-condensible gas into the chamber; and control means associated with the chamber and the injecting means for maintaining the total pressure of chamber at a pressure which is at or slightly below the triple pressure of the droplet-forming liquid while maintaining a low partial pressure of the droplet-forming liquid so that the droplets freeze into solid bodies of relatively high density by controlling the rate of injection of the non-condensible gas into the chamber.

2. The system as defined in claim 1 wherein the control means includes means for regulating the injection of the non-condensible gas into the chamber to maintain the chamber at the desired conditions.

3. The system as defined in claim 1 wherein the control means includes means for monitoring the internal pressure of the chamber and means for adjusting the rate of injection of the non-condensible gas into the chamber in response to the monitored pressure to maintain the chamber at the desired conditions.

4. The system as defined in claim 1 wherein the means for introducing includes a reservoir for holding an quantity of the liquid material and at least one nozzle through which liquid material is discharged from the reservoir into the chamber.

5. The system as defined in claim 1 wherein the liquid material is liquid argon and the non-condensible gas is helium gas.

6. The system as defined in claim 1 wherein the liquid material is liquid carbon dioxide and the non-condensible gas is relatively dry air or nitrogen.

7. A method for producing cryogenic pellets from a liquid material having a relatively high triple point pressure, the method comprising the steps of:

providing a chamber having an entrance end portion and an exit end portion;

introducing the liquid material into the entrance end portion of the chamber as a liquid jet so that the jet disintegrates into droplets;

injecting a non-condensible gas into the chamber; and maintaining the total pressure of chamber at a pressure which is at or slightly below the triple pressure of the droplet-forming liquid while maintaining a low partial pressure of the droplet-forming liquid so that the droplets freeze into solid bodies of relatively high density.

8. The method as defined in claim 7 wherein the step of maintaining includes a step of controlling the rate of injection of the non-condensible gas into the chamber to maintain the chamber at the desired conditions.

9. The method as defined in claim 7 wherein the step of maintaining includes a steps of monitoring the internal pressure of the chamber and adjusting the rate of injection of the non-condensible gas into the chamber in response to the monitored pressure to maintain the chamber at the desired conditions.

* * * * *

UNITED STATES PATENT AND TRADEMARK OFFICE

CERTIFICATE OF CORRECTION

PATENT NO. : 5,666,821

DATED : September 16, 1997

INVENTOR(S) : Christopher A. Foster et al

It is certified that error appears in the above-indentified patent and that said Letters Patent is hereby corrected as shown below:

Column 1, between the text ending on line 5 and the heading "Background of the Invention" on line 7, the following paragraph should appear:

--This invention was made with Government support under Contract No. DE-AC05-96OR22464 awarded by the Office of Basic Energy Sciences Chemical Sciences Division of the U.S. Department of Energy to Lockheed Martin Energy Research Corporation, and the Government has certain rights in the invention.--

Signed and Sealed this

Ninth Day of February, 1999

*Attest:*

*Acting Commissioner of Patents and Trademarks*

*Attesting Officer*